US011790835B2

(12) United States Patent
Suzuki

(10) Patent No.: US 11,790,835 B2
(45) Date of Patent: Oct. 17, 2023

(54) DISPLAY DEVICE

(71) Applicant: KYOCERA Corporation, Kyoto (JP)

(72) Inventor: Takanobu Suzuki, Itami (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 17/631,159

(22) PCT Filed: Jul. 6, 2020

(86) PCT No.: PCT/JP2020/026470
§ 371 (c)(1),
(2) Date: Jan. 28, 2022

(87) PCT Pub. No.: WO2021/020042
PCT Pub. Date: Feb. 4, 2021

(65) Prior Publication Data

US 2022/0189385 A1 Jun. 16, 2022

(30) Foreign Application Priority Data

Jul. 31, 2019 (JP) ..... 2019-141519

(51) Int. Cl.
*G09G 3/32* (2016.01)

(52) U.S. Cl.
CPC ..... *G09G 3/32* (2013.01); *G09G 2300/026* (2013.01); *G09G 2310/0262* (2013.01); *G09G 2310/0267* (2013.01); *G09G 2310/08* (2013.01); *G09G 2320/0646* (2013.01)

(58) Field of Classification Search
CPC ..... G09G 2320/0626; G09G 3/3208; G09G 2320/0276; G09G 2330/021; G09G 2320/0233; G09G 3/3266; G09G 2320/0271; G09G 2300/0809;
(Continued)

(56) References Cited

U.S. PATENT DOCUMENTS

| | | | |
|---|---|---|---|
| 7,227,519 | B1 | 6/2007 | Kawase et al. |
| 9,997,099 | B2 * | 6/2018 | Miyagawa ..... H01L 27/1222 |
| 2003/0030603 | A1 | 2/2003 | Shimoda |

(Continued)

FOREIGN PATENT DOCUMENTS

| | | | |
|---|---|---|---|
| JP | 2001-350442 | A | 12/2001 |
| JP | 2003-58106 | A | 2/2003 |

(Continued)

*Primary Examiner* — Shaheda A Abdin
(74) *Attorney, Agent, or Firm* — PROCOPIO CORY HARGREAVES AND SAVITCH LLP

(57) ABSTRACT

A display device includes a data signal line, a low-tone scanning line, a high-tone scanning line, a low-tone emission control line, a high-tone emission control line, a signal line drive circuit that outputs an image signal to the data signal line, a scanning line drive circuit that outputs a selection signal to the low-tone scanning line and to the high-tone scanning line, and first and second power supply lines that receive power from a power supply. Pixel units each include a low-tone scanning transistor, a high-tone scanning transistor, a low-tone capacitor, a high-tone capacitor, a low-tone drive transistor, a high-tone drive transistor, a low-tone emission control transistor, a high-tone emission control transistor, and a light emitter. The display device drives the light emitter by dividing a high tone and a low tone in time series.

15 Claims, 7 Drawing Sheets

(58) Field of Classification Search
CPC ..... H01L 27/3209; H01L 2924/12044; H01L 51/5296
See application file for complete search history.

(56) References Cited

U.S. PATENT DOCUMENTS

| | | | | |
|---|---|---|---|---|
| 2004/0070557 | A1 | 4/2004 | Asano et al. | |
| 2004/0263440 | A1 | 12/2004 | Kimura et al. | |
| 2006/0152452 | A1 | 7/2006 | Hoppenbrouwers et al. | |
| 2008/0055196 | A1* | 3/2008 | Izumida | G09G 3/32 345/46 |
| 2010/0141646 | A1 | 6/2010 | Tanabe | |
| 2015/0042703 | A1* | 2/2015 | Chaji | G09G 3/3233 345/694 |
| 2017/0186373 | A1* | 6/2017 | Nishikawa | G09G 3/3258 |
| 2018/0190747 | A1* | 7/2018 | Son | G09G 3/32 |

FOREIGN PATENT DOCUMENTS

| | | | | |
|---|---|---|---|---|
| JP | 2004-133240 | A | 4/2004 | |
| JP | 2004-341314 | A | 12/2004 | |
| JP | 2007-279412 | A | 10/2007 | |
| JP | 2007-528016 | A1 | 10/2007 | |
| JP | 2007279412 | A * | 10/2007 | G09G 3/30 |
| JP | 2009-8731 | A | 1/2009 | |
| JP | 2018-194693 | A | 12/2018 | |
| WO | 2009/013806 | A1 | 1/2009 | |

* cited by examiner

DISPLAY DEVICE

FIELD

The present disclosure relates to a high-definition, high-contrast display device including pixel units including self-luminous light emitters such as light-emitting diodes (LEDs) and organic electroluminescence (EL) elements arranged in a matrix, in which image data is written to the pixel units using selection signals and emission signals.

BACKGROUND

A known display device includes multiple self-luminous light emitters such as LEDs and EL elements. Each light emitter emits light with a luminance level corresponding to the level of a current flowing through it from the anode to the cathode. Such light emitters are driven by thin film transistors (TFT). Each TFT receives an image signal written to a gate node through a source line while a gate line is active. The light intensity of each light emitter is thus controlled with a current in accordance with a gate voltage of the corresponding TFT, thus expressing tones (refer to, for example, Patent Literatures 1 and 2).

The tone control for light emitters with the known techniques described in Patent Literatures 1 and 2 simply uses a current applied to the light emitters. For a range of low tones, the light emitters are driven with a low current. With a current in a low current range, light emitters such as LEDs can have an extremely lower luminous efficiency and largely varying characteristics including a change in luminescent chromaticity (luminous wavelength), thus possibly degrading the display quality. This can be more notable in a display device intending to achieve a high target contrast ratio.

CITATION LIST

Patent Literature

Patent Literature 1: Japanese Unexamined Patent Application Publication No. 2003-58106

Patent Literature 2: Japanese Unexamined Patent Application Publication No. 2004-133240

BRIEF SUMMARY

A display device according to an aspect of the present disclosure includes a plurality of pixel units arranged in a matrix of rows and columns. Each of the plurality of pixel units includes a light emitter and a pixel circuit. The light emitter emits light with a luminance level changeable in response to a level of a current. The pixel circuit causes the light emitter to emit light with a luminance level corresponding to a tone resulting from an image signal. The pixel circuit includes a low-tone driver that drives the light emitter in response to a tone resulting from an image signal being within a low-tone range of tones below or equal to a predetermined tone and does not drive the light emitter in response to a tone resulting from an image signal being within a high-tone range of tones above the predetermined tone, and a high-tone driver that does not drive the light emitter in response to a tone resulting from an image signal being within the low-tone range and drives the light emitter in response to a tone resulting from an image signal being within the high-tone range.

BRIEF DESCRIPTION OF DRAWINGS

The objects, features, and advantages of the present invention will become more apparent from the following detailed description and the drawings.

DETAILED DESCRIPTION

One or more embodiments of the present invention will now be described in detail with reference to the drawings.

First Embodiment

Figure 1:
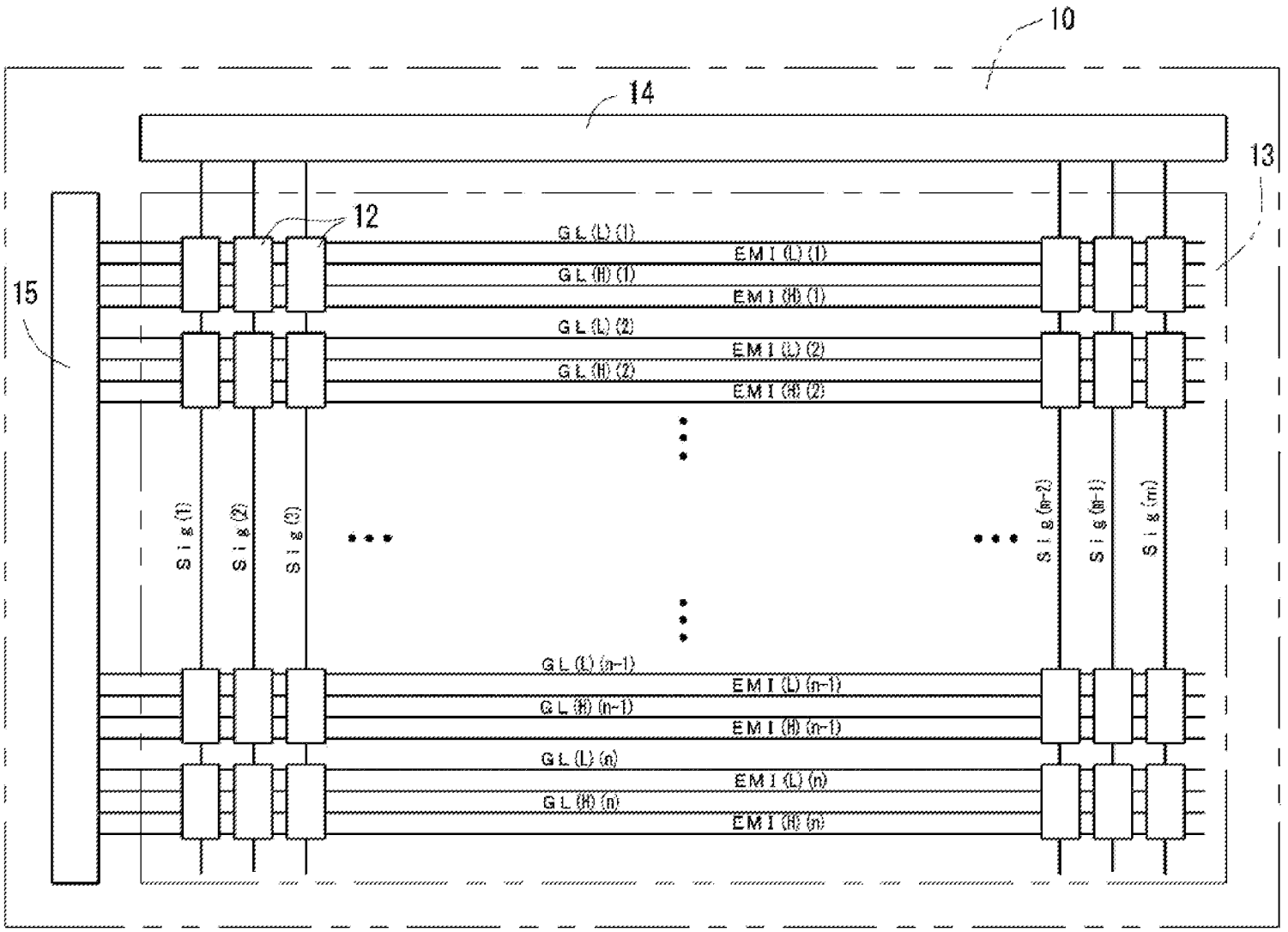
FIG. 1 is an electric circuit diagram of a display device according to one embodiment of the present disclosure, showing its schematic configuration.
Figure 2:
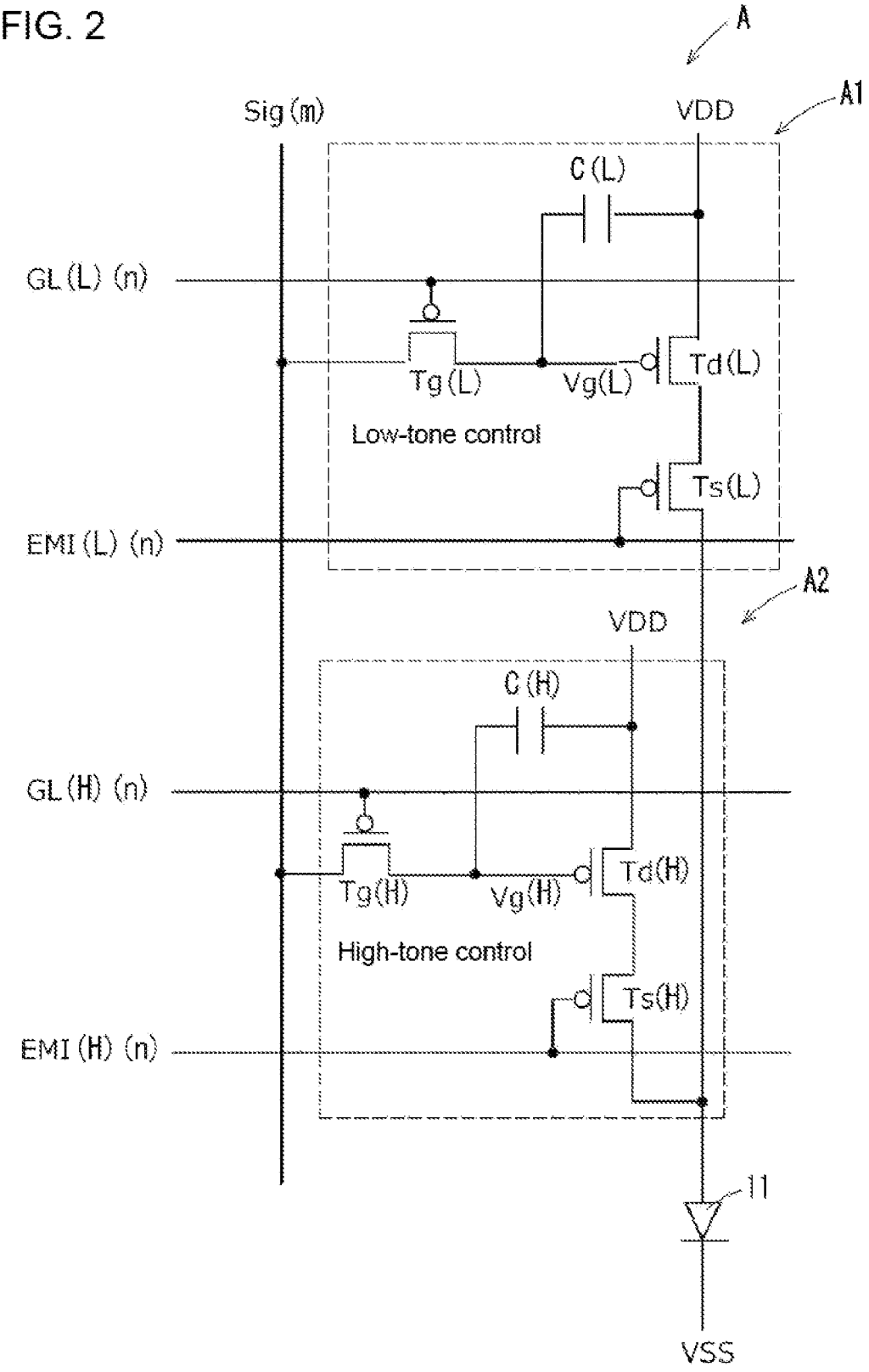
FIG. 2 is an electric circuit diagram of a pixel unit in the display device shown in FIG. 1.

FIG. 1 is an electric circuit diagram of a display device according to one embodiment of the present disclosure, showing its schematic configuration. FIG. 2 is an electric circuit diagram of a pixel unit in the display device shown in FIG. 1. A display device 10 according to the present embodiment includes a display screen 13 including multiple pixel units 12 arranged in a matrix of n rows and m columns. The pixel units 12 each include a self-luminous light emitter 11 that emits light with a luminance level that changes in response to the level of a current.

Figure 4:
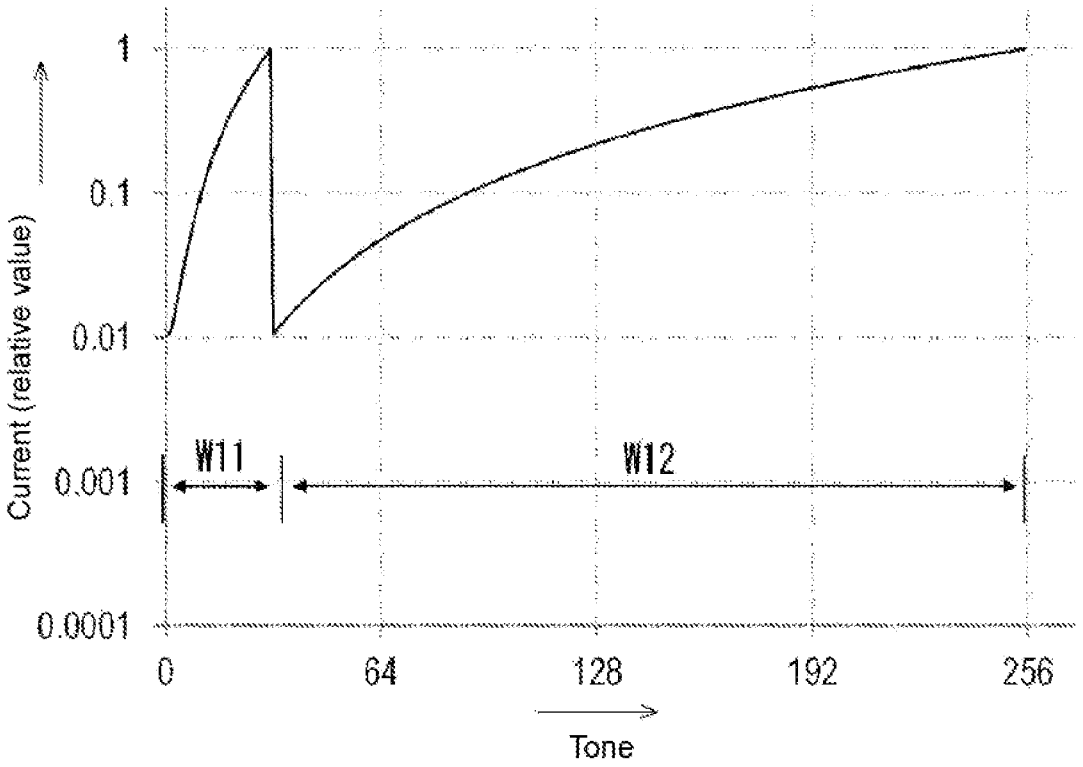
FIG. 4 is a graph showing the relationship between a tone and a current flowing through a light emitter.

The display device 10 includes pixel circuits A that operate in response to image signals input by an external device. Each pixel circuit A operates in two different time periods, a low-tone emission period W11 and a high-tone emission period W12 as shown in FIG. 4 (described later). During the low-tone emission period W11, image signals for causing pixel units to emit light are written to a set of pixel units 12 for emitting light with a low tone. During the high-tone emission period W12, image signals for causing pixel units to emit light are written to a set of pixel units 12 for emitting light with a high tone.

The pixel circuit A includes a low-tone driver A1 and a high-tone driver A2. The low-tone driver A1 drives the light emitter 11 in response to a tone resulting from an image signal being within a low-tone range of tones below or equal to a predetermined tone, and does not drive the light emitter 11 in response to a tone resulting from an image signal being within a high-tone range of tones above the predetermined tone. The high-tone driver A2 does not drive the light emitter 11 in response to a tone resulting from an image signal being within the low-tone range, and drives the light emitter 11 in response to a tone resulting from an image signal being within the high-tone range. The low-tone driver A1 and the high-tone driver A2 are selectively driven independently of each other.

The display device 10 includes m data signal lines Sig (1) to (m) (collectively referred to as data signal lines Sig) arranged in each column in the matrix of the multiple pixel units 12, n low-tone scanning lines GL(L) (1) to (n) (collectively referred to as low-tone scanning lines GL(L)) arranged in each row in the matrix, high-tone scanning lines GL(H) (1) to (n) (collectively referred to as high-tone scanning lines GL(H)) arranged in each row in the matrix, low-tone emission control lines EMI(L) (1) to (n) (collectively referred to as low-tone emission control lines EMI(L)) arranged in each row in the matrix, high-tone emission control lines EMI(H) (1) to (n) (collectively referred to as high-tone emission control lines EMI(H)) arranged in each row in the matrix, a signal line drive circuit 14 to output image signals to the data signal lines Sig, a scanning line drive circuit 15 to output selection signals to the low-tone scanning lines GL(L) and the high-tone scanning lines GL(H), a first power supply line VDD through which electric power is supplied, and a second power supply line VSS having an electric potential different from an electric potential of the first power supply line VDD (e.g., a predetermined positive potential), such as a predetermined negative potential or a ground potential. With the second power supply line VSS having a ground potential, the pixel circuit A and its peripheral circuits operate substantially at a positive potential alone, more likely with a simpler circuit structure.

Each pixel unit 12 includes a pixel circuit including a low-tone scanning transistor Tg(L), a high-tone scanning transistor Tg(H), a low-tone capacitor C(L), a high-tone capacitor C(H), a low-tone drive transistor Td(L), a high-tone drive transistor Td(H), a low-tone emission control transistor Ts(L), and a high-tone emission control transistor Ts(H). The low-tone scanning transistor Tg(L) has a gate terminal connected to the low-tone scanning line GL(L) and a source terminal connected to the data signal line Sig. The high-tone scanning transistor Tg(H) has a gate terminal connected to the high-tone scanning line GL(H) and a source terminal connected to the data signal line Sig. The low-tone capacitor C(L) has a first terminal connected to a drain terminal of the low-tone scanning transistor Tg(L) and a second terminal connected to the first power supply line VDD. The high-tone capacitor C(H) has a first terminal connected to a drain terminal of the high-tone scanning transistor Tg(H) and a second terminal connected to the first power supply line VDD. The low-tone drive transistor Td(L) has a gate terminal connected to the first terminal of the low-tone capacitor C(L) and a source terminal connected to the first power supply line VDD. The high-tone drive transistor Td(H) has a gate terminal connected to the first terminal of the high-tone capacitor C(H) and a source terminal connected to the first power supply line VDD. The low-tone emission control transistor Ts(L) has a gate terminal connected to the low-tone emission control line EMI(L), a drain terminal connected to the anode of the light emitter 11, and a source terminal connected to a drain terminal of the low-tone drive transistor Td(L). The high-tone emission control transistor Ts(H) has a gate terminal connected to the high-tone emission control line EMI(H), a drain terminal connected to the anode of the light emitter 11, and a source terminal connected to a drain terminal of the high-tone drive transistor Td(H).

As described above, the low-tone driver A1 includes the low-tone scanning transistor Tg(L) having the gate terminal connected to the low-tone scanning line GL(L) and the source terminal connected to the data signal line Sig, the low-tone capacitor C(L) having the first terminal connected to the drain terminal of the low-tone scanning transistor Tg(L) and the second terminal connected to the first power supply line VDD, the low-tone drive transistor Td(L) having the gate terminal connected to the first terminal of the low-tone capacitor C(L) and the source terminal connected to the first power supply line VDD, and the low-tone emission control transistor Ts(L) having the gate terminal connected to the low-tone emission control line EMI(L), the drain terminal connected to the anode of the light emitter 11, and the source terminal connected to the drain terminal of the low-tone drive transistor Td(L).

The high-tone driver A2 includes the high-tone scanning transistor Tg(H) having the gate terminal connected to the high-tone scanning line GL(H) and the source terminal connected to the data signal line Sig, the high-tone capacitor C(H) having the first terminal connected to the drain terminal of the high-tone scanning transistor Tg(H) and the second terminal connected to the first power supply line VDD, the high-tone drive transistor Td(H) having the gate terminal connected to the first terminal of the high-tone capacitor C(H) and the source terminal connected to the first power supply line VDD, and the high-tone emission control transistor Ts(H) having the gate terminal connected to the high-tone emission control line EMI(H), the drain terminal connected to the anode of the light emitter 11, and the source terminal connected to the drain terminal of the high-tone drive transistor Td(H).

The light emitter 11 is connected in series between the drain terminal of the low-tone emission control transistor Ts(L) and the second power supply line VSS and between the drain terminal of the high-tone emission control transistor Ts(H) and the second power supply line VSS. More specifically, the light emitter 11 has the anode connected in parallel to the drain terminal of the low-tone emission control transistor Ts(L) and the drain terminal of the high-tone emission control transistor Ts(H). The light emitter 11 has the cathode connected to the second power supply line VSS. Each pixel unit 12 includes the light emitter 11 and the pixel circuit A described above.

The first power supply line VDD receives, for example, a positive power supply voltage of about 3 V. The second power supply line VSS receives, for example, a power supply voltage lower than the voltage for the first power supply line VDD, which may be about the ground potential ±0 V or a negative potential of, for example, about −5 V. For example, the potential difference between the voltage at the first power supply line VDD and the voltage at the second power supply line VSS is 8 V. In this case, the voltage at the second power supply line VSS is −5 V when the voltage at the first power supply line VDD is 3 V, and the voltage at the second power supply line VSS is 0 V when the voltage at the first power supply line VDD is 8 V.

The low-tone scanning transistor Tg(L), the high-tone scanning transistor Tg(H), the low-tone drive transistor Td(L), the high-tone drive transistor Td(H), the low-tone emission control transistor Ts(L), and the high-tone emission control transistor Ts(H) described above may be p-channel thin film transistors (TFTs). In response to a low signal (low-level signal) input into its gate electrode, a p-channel TFT has its source and its drain electrically connected to enter an on-state, thus allowing a current to flow.

A TFT includes a semiconductor film containing, for example, amorphous silicon (a-Si) or low temperature polycrystalline silicon (LTPS), and is a three-terminal element having a gate electrode as a gate terminal, a source electrode as a source terminal, and a drain electrode as a drain terminal. The TFT serves as a switching element (transfer gate element) by allowing a current to flow through the semiconductor film (channel) between the source electrode and the drain electrode in response to a voltage of a predetermined potential applied to the gate electrode.

The low-tone emission control transistor Ts(L) receives, from the low-tone emission control line EMI(L), an emission control signal for controlling an emission period at its gate electrode, and provides a drive current from the low-tone drive transistor Td(L) to the light emitter 11 during the active period of the received emission control signal. The high-tone emission control transistor Ts(H) receives, from the high-tone emission control line EMI(H), an emission control signal for controlling the emission period at its gate electrode, and provides a drive current from the high-tone drive transistor Td(H) to the light emitter 11 during the active period of the received emission control signal.

The low-tone capacitor C(L) as a capacitor is connected in parallel between the gate terminal and the source terminal of the low-tone drive transistor Td(L). The high-tone capacitor C(H) as a capacitor is connected in parallel between the gate terminal and the source terminal of the high-tone drive transistor Td(H). The low-tone capacitor C(L) retains the voltage of the image signal input into the gate terminal of the low-tone drive transistor Td(L) until subsequent rewriting is performed (for a period of one frame). The high-tone capacitor C(H) retains the voltage of the image signal input into the gate terminal of the high-tone drive transistor Td(H) until subsequent rewriting is performed (for a period of one frame).

Image data signals are provided from the signal line drive circuit 14 to the pixel units 12 through the data signal lines Sig. Scanning signals are provided from the scanning line drive circuit 15 to the pixel units 12 through the low-tone scanning lines GL(L) and the high-tone scanning lines GL(H). Emission control signals are provided from the scanning line drive circuit 15 to the pixel units 12 through the low-tone emission control lines EMI(L) and the high-tone emission control lines EMI(H).

The light emitters 11 may be any self-luminous light emitters such as micro-light-emitting diodes (LEDs), monolithic LEDs, organic electroluminescence (EL) elements, inorganic EL elements, and semiconductor laser elements.

Each of the pixel units 12 may include a subpixel for emitting red light, a subpixel for emitting green light, and a subpixel for emitting blue light. The subpixel for emitting red light includes a red light emitter such as a red LED. The subpixel for emitting green light includes a green light emitter such as a green LED. The subpixel for emitting blue light includes a blue light emitter such as a blue LED. For example, these subpixels may be arranged in the column direction, or may be arranged in the row direction.

The operation of the display device 10 will now be described.

Figure 3:
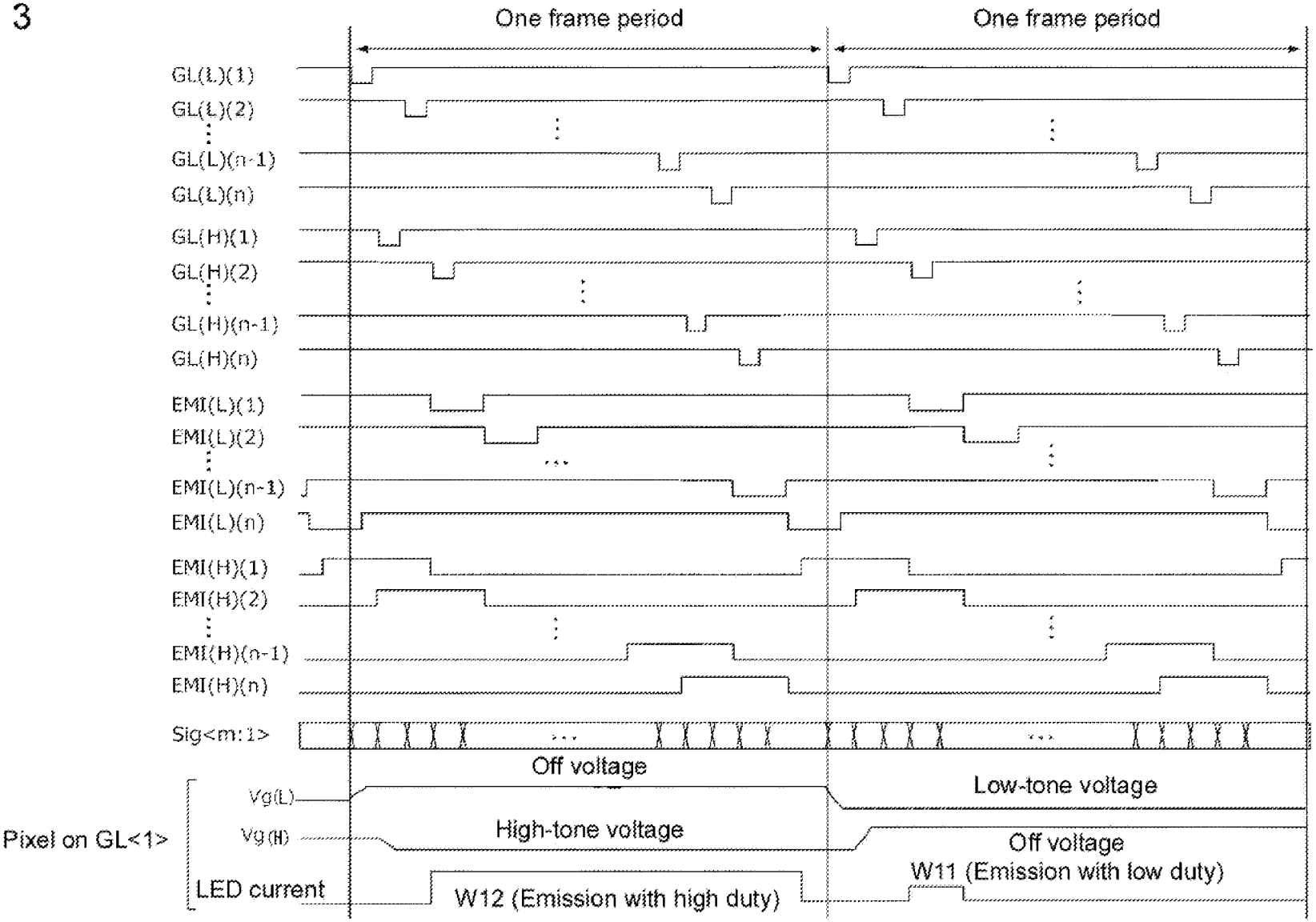
FIG. 3 is a timing chart describing the operation of the display device shown in FIG. 1.

FIG. 3 is a timing chart describing the operation of the display device shown in FIG. 1. The multiple pixel units 12 arranged in the matrix of m rows and n columns (m and n are positive integers) each have the same structure. The operation of one pixel unit will now be described. For one pixel unit, image signal writing is performed twice in total, once for a low tone and once for a high tone. With a low-tone scanning signal line GL(L) being active, writing is performed on the low-tone drive transistor Td(L). Subsequently, with a high-tone scanning signal line GL(H) being active, writing is performed on the high-tone drive transistor Td(H). Data to be written is alternately provided to the low-tone drive transistor Td(L) and to the high-tone drive transistor Td(H) through the data signal line Sig in a time-divided manner.

To cause the light emitter 11 to emit light with a high tone, a high-tone drive voltage is written to the high-tone drive transistor Td(H) and an off voltage is written to the low-tone drive transistor Td(L). To cause the light emitter 11 to emit light with a low tone, a low-tone drive voltage is written to the low-tone drive transistor Td(L) and an off voltage is written to the high-tone drive transistor Td(H). For the emission control, a drive signal for the emission period W11 with a low duty ratio is output to the low-tone emission control line EMI(L), and a drive signal for the emission period W12 with a high duty ratio is output to the high-tone emission control line EMI(H).

FIG. 4 is a graph showing the relationship between a tone and a current flowing through a light emitter. To achieve a high contrast ratio as in the display device 10 according to the present embodiment, the light emitters 11 are to be driven to have a wide range of luminance levels by driving the light emitters 11 with a current in a wide range. In the present embodiment, the light emitters 11 are driven at a lower duty ratio, such as in a range of about 0.1 to 10%, during the low-tone emission period W11 than the high-tone emission period W12 to allow a light emission current of a greater level to be used for the light emitters 11 for the low-tone range. This eliminates use of a low current range in which the light emitters 11 can have low luminous efficiency and largely varying characteristics. This structure also narrows the range of currents used for the light emitters 11 for all tones, thus reducing variations in luminescent chromaticity dependent on the light emission current.

Second Embodiment

Figure 5:
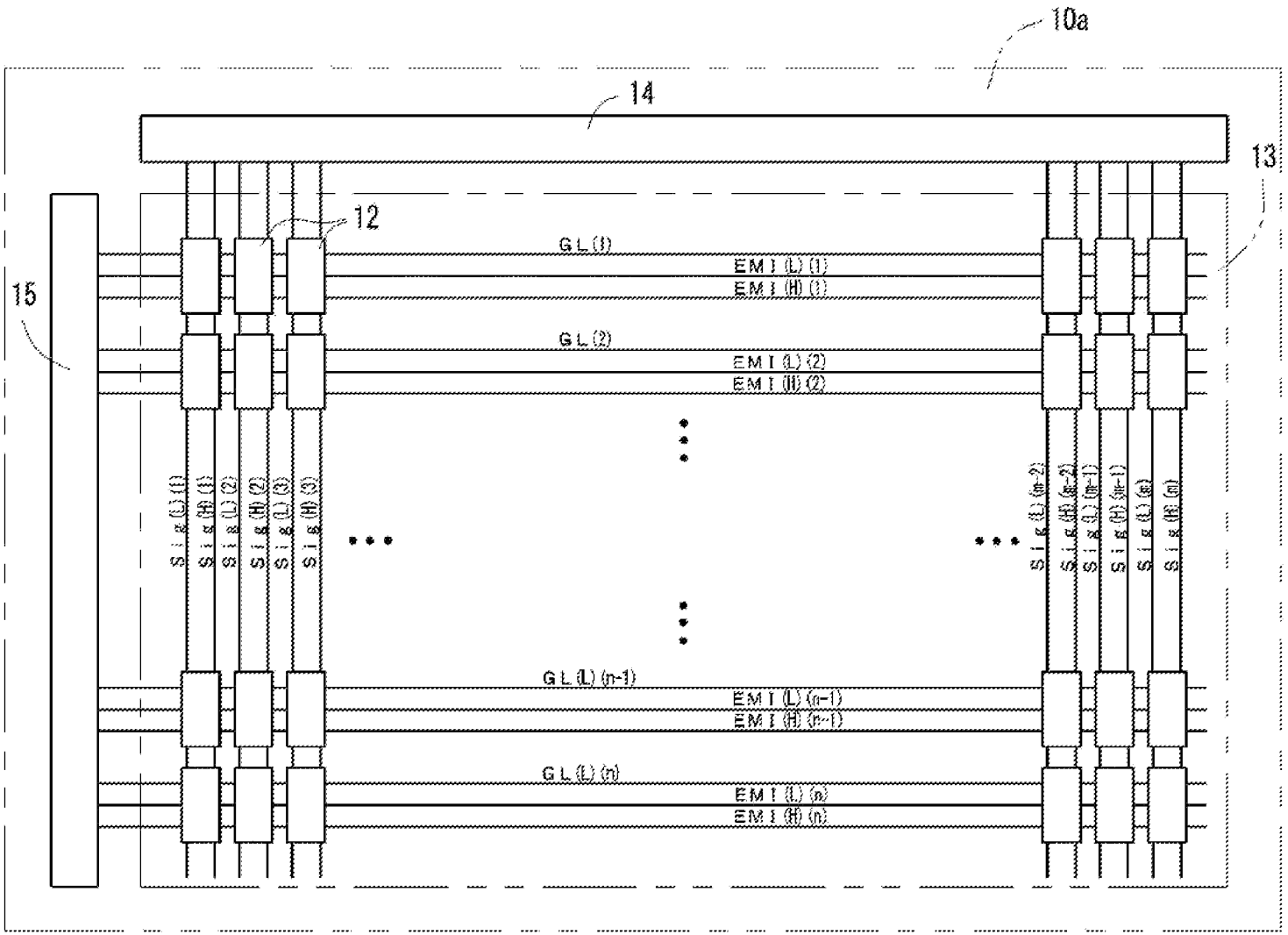
FIG. 5 is an electric circuit diagram of a display device according to another embodiment of the present disclosure, showing its schematic configuration.
Figure 6:
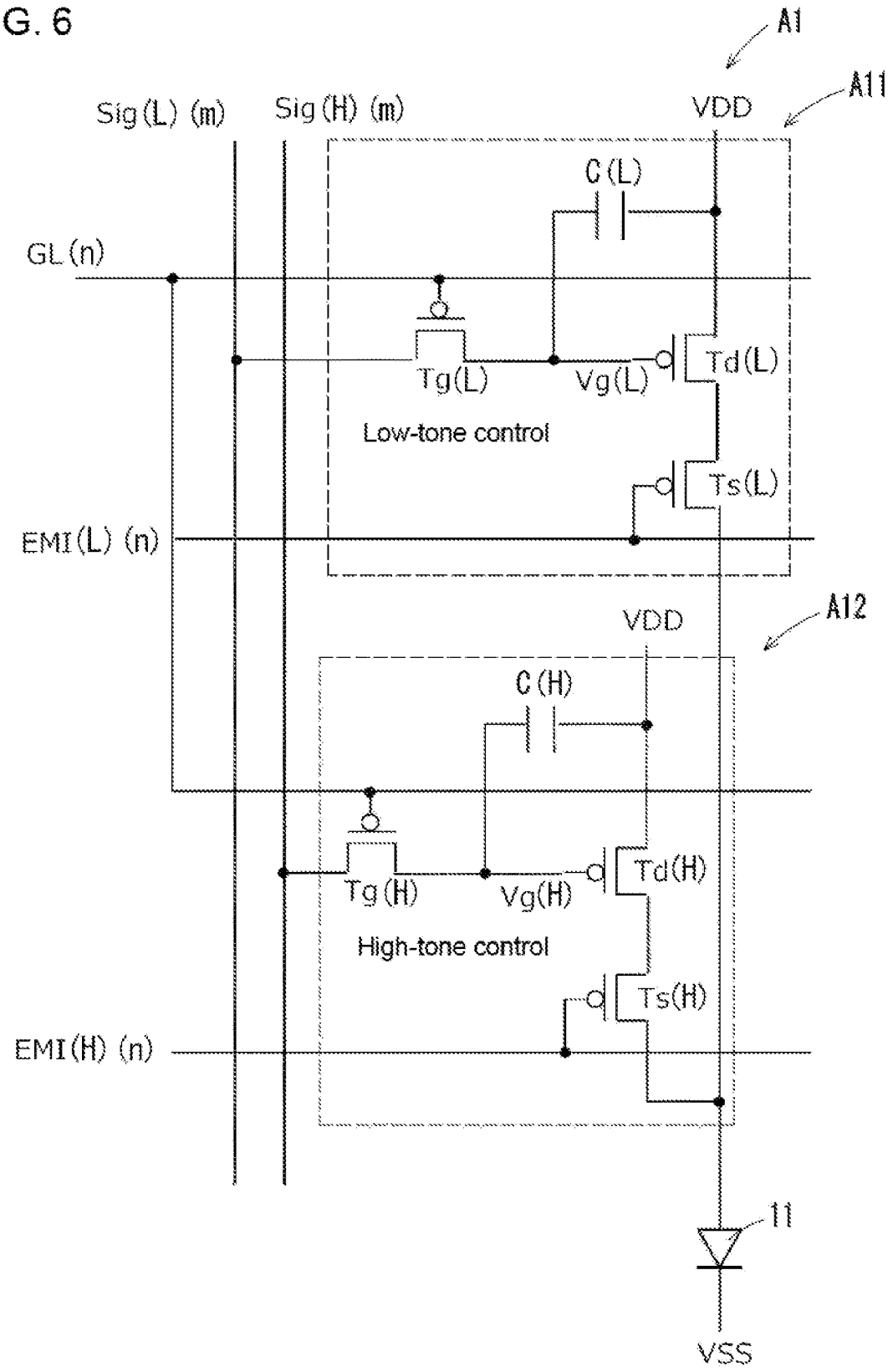
FIG. 6 is an electric circuit diagram of a pixel unit in the display device shown in FIG. 5.
Figure 7:
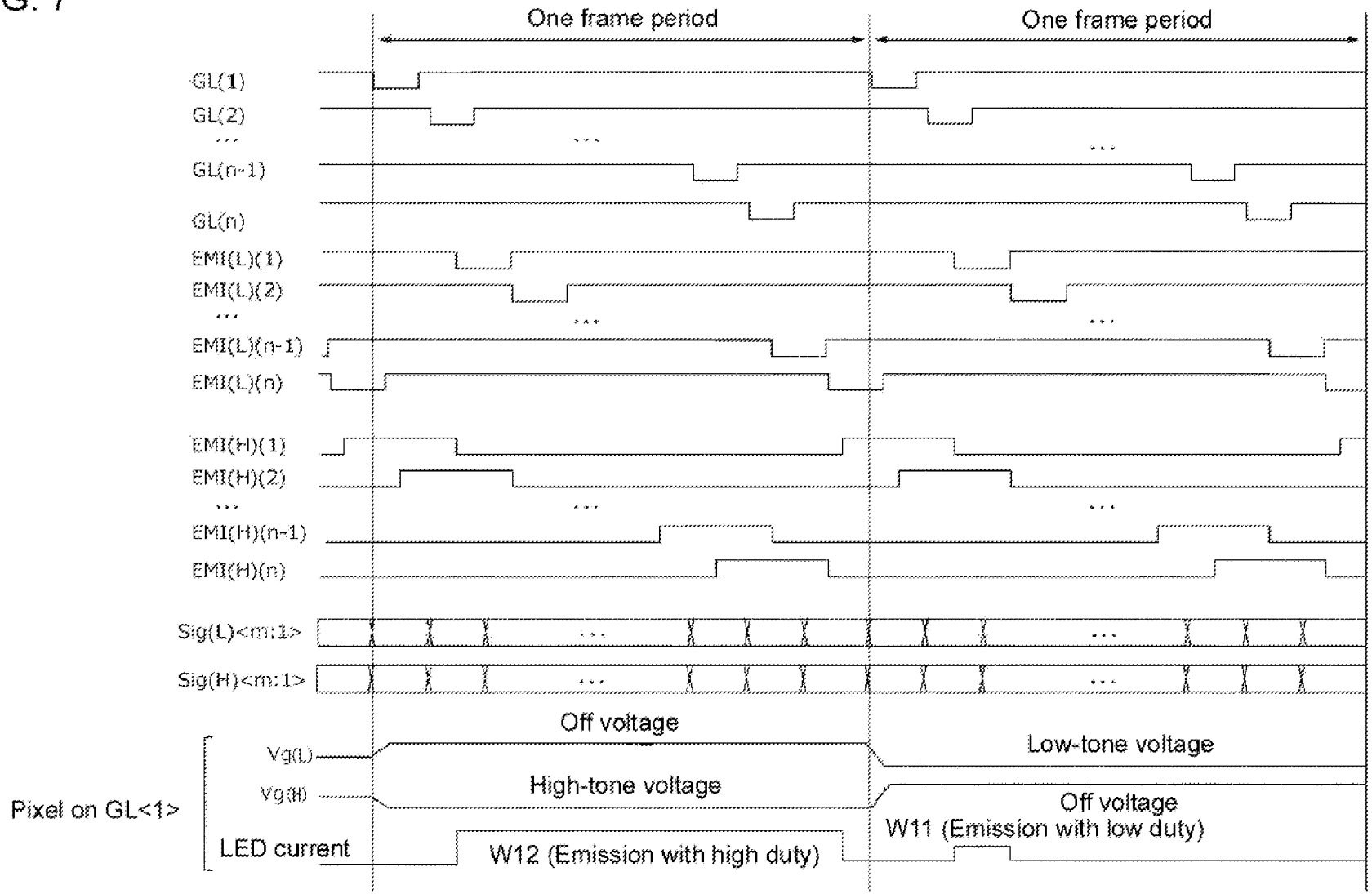
FIG. 7 is a timing chart describing the operation of the display device shown in FIG. 5.

FIG. 5 is an electric circuit diagram of a display device according to another embodiment of the present disclosure, showing its schematic configuration. FIG. 6 is an electric circuit diagram of a pixel unit in the display device shown in FIG. 5. The same components corresponding to the above embodiment are given the same reference numerals as those components.

A display device 10*a* according to the present embodiment includes m low-tone data signal lines Sig(L) (1) to (m) (collectively referred to as data signal lines Sig(L)) arranged in each column in a matrix of multiple pixel units 12, m high-tone data signal lines Sig(H) (1) to (m) (collectively referred to as data signal lines Sig(H)) arranged in each column in the matrix, n scanning lines GL (1) to (n) (collectively referred to as scanning lines GL) arranged in each row in the matrix, n low-tone emission control lines EMI(L) arranged in each row in the matrix, n high-tone emission control lines EMI(H) arranged in each row in the matrix, a signal line drive circuit 14 to output image signals to the data signal lines Sig(L) and the data signal lines Sig(H), a scanning line drive circuit 15 to output selection signals to the scanning lines GL, a first power supply line VDD through which electric power is supplied, and a second power supply line VSS having an electric potential different from an electric potential of the first power supply line VDD (e.g., a predetermined positive potential), such as a predetermined negative potential or a ground potential. With the second power supply line VSS having a ground potential, a pixel circuit A1 and its peripheral circuits operate substantially at a positive potential alone, more likely with a simpler circuit structure.

Each pixel unit 12 includes the pixel circuit A1 including a low-tone scanning transistor Tg(L), a high-tone scanning transistor Tg(H), a low-tone capacitor C(L), a high-tone capacitor C(H), a low-tone drive transistor Td(L), a high-tone drive transistor Td(H), a low-tone emission control transistor Ts(L), and a high-tone emission control transistor Ts(H). The low-tone scanning transistor Tg(L) has a gate terminal connected to the scanning line GL and a source terminal connected to the low-tone data signal line Sig(L). The high-tone scanning transistor Tg(H) has a gate terminal connected to the scanning line GL and a source terminal connected to the high-tone data signal line Sig(H). The low-tone capacitor C(L) has a first terminal connected to a drain terminal of the low-tone scanning transistor Tg(L) and a second terminal connected to the first power supply line VDD. The high-tone capacitor C(H) has a first terminal connected to a drain terminal of the high-tone scanning transistor Tg(H) and a second terminal connected to the first power supply line VDD. The low-tone drive transistor Td(L) has a gate terminal connected to the first terminal of the low-tone capacitor C(L) and a source terminal connected to the first power supply line VDD. The high-tone drive transistor Td(H) has a gate terminal connected to the first terminal of the high-tone capacitor C(H) and a source terminal connected to the first power supply line VDD. The low-tone emission control transistor Ts(L) has a gate terminal connected to the low-tone emission control line EMI(L), a drain terminal connected to the anode of the light emitter 11, and a source terminal connected to a drain terminal of the low-tone drive transistor Td(L). The high-tone emission control transistor Ts(H) has a gate terminal connected to the high-tone emission control line EMI(H), a drain terminal connected to the anode of the light emitter 11, and a source terminal connected to a drain terminal of the high-tone drive transistor Td(H).

The light emitter 11 is connected in series between the drain terminal of the low-tone emission control transistor Ts(L) and the second power supply line VSS and between the drain terminal of the high-tone emission control transistor Ts(H) and the second power supply line VSS. More specifically, the light emitter 11 has the anode connected in parallel to the drain terminal of the low-tone emission control transistor Ts(L) and the drain terminal of the high-tone emission control transistor Ts(H). The light emitter 11 has the cathode connected to the second power supply line VSS. Each pixel unit 12 includes the light emitter 11 and the pixel circuit A1 described above.

In this embodiment, as in the embodiment described above with reference to FIGS. 1 to 4, the structure also includes a pair of the low-tone drive transistor Td(L) and the low-tone emission control transistor Ts(L) and a pair of the high-tone drive transistor Td(H) and the high-tone emission control transistor Ts(H) and combines outputs from these transistors to drive the light emitter 11. In the present embodiment, two different data signal lines, the low-tone data signal line Sig(L) and the high-tone data signal line Sig(H), and one scanning signal line GL are used to write data signals to the low-tone drive transistor Td(L) and the high-tone drive transistor Td(H) at the same time. More specifically, a low-tone driver A11 and a high-tone driver A21 included in the pixel circuit A1 are selectively driven at the same time. This allows the light emitter 11 to be driven at a high frame frequency. Data signals Sig(L) and Sig(H) are written to the low-tone drive transistor Td(L) and the high-tone drive transistor Td(H) at the same time, using a single scanning signal (gate signal). This takes less time for writing per frame than for writing a low tone and a high tone sequentially.

The display device according to the present disclosure may include multiple substrates 1 each including multiple light emitters 11 as shown in FIG. 1. The multiple substrates 1 may be arranged in a grid on the same plane. The substrates 1 may be connected (tiled) together with their side surfaces bonded with, for example, an adhesive. The display device may thus be a composite and large multi-display.

The display device according to the present disclosure can drive the light emitters for the low-tone range with a high current. This eliminates the operation of the light emitters in a current range in which the light emitters can have low luminous efficiency and largely varying characteristics, thus enabling high-quality image display with a high contrast ratio.

The display device according to the present disclosure may be implemented in forms 1 to 9 described below in the above embodiments.

(1) The low-tone drivers A1 and A11 drive the light emitters 11 with a current having a maximum level greater than or equal to a maximum level of a current with which the high-tone drivers A2 and A12 drive the light emitters 11. In this case, the light emitters for the low-tone range can be driven with a current in a high current range. This eliminates the operation of light emitters in the low current range in which the light emitters can have low luminous efficiency and largely varying characteristics, thus enabling higher-quality image display with a higher contrast ratio.

(2) The light emitters 11 may emit light with a chromaticity level changeable in response to a level of a current. In this case, the low-tone drivers A1 and A11 and the high-tone drivers A2 and A12 are driven in a time-divided manner, and the level of the drive current can be greater for the low-tone drivers A1 and A11. This eliminates the operation of the light emitters 11 with a current in a low current range in which the light emitters 11 can have large variations in varying luminescent chromaticity (luminous wavelengths). The display device according to one or more embodiments of the present disclosure may thus use the light emitters 11 that emit light with a chromaticity level changeable in response to a level of a current.

(3) The light emitters 11 may include LEDs. In this case, the LEDs are driven at a low voltage of about 2 to 3.5 V and have a long service life. The LEDs emit light with a chromaticity level that is likely to change in response to the level of a current, particularly in a low current range. The display device according to one or more embodiments of the present disclosure may thus use the LEDs.

(4) The predetermined tone may be within a range of ⅛ to ¼ of the highest tone. In this case, a range of tones below or equal to the predetermined tone is a low-tone range. The light emitters for this low-tone range can be driven with a current in a high current range in a time-divided manner easily.

(5) The highest tone may be 256, and the predetermined tone may be within a range of 32 to 64. In this case, the highest tone is 256, allowing colors and brightness with slight differences to be expressed with high accuracy. The predetermined tone is within a range of 32 to 64. A range of tones below or equal to the predetermined tone is a low-tone range. The light emitters for this low-tone range can be driven with a current in a high current range in a time-divided manner easily.

(6) The display device may include a duty ratio controller to control a low-tone duty ratio for one frame period of the low-tone emission period W11 and a high-tone duty ratio for one frame period of the high-tone emission period W12. In response to a luminance adjustment signal for the multiple pixel units 12, the duty ratio controller may maintain a constant ratio between the low-tone duty ratio and the high-tone duty ratio and change the low-tone duty ratio and the high-tone duty ratio. In this structure, the duty ratio controller maintains the constant ratio between the low-tone duty ratio and the high-tone duty ratio, but can also change the low-tone duty ratio and the high-tone duty ratio. This improves the performance of the duty ratio controller such as the operability and the operation speed and simplifies the circuit structure.

The duty ratio controller may be a control circuit included in the scanning line drive circuit 15. When the scanning line drive circuit 15 includes driving elements such as integrated circuits (ICs) and large-scale integration (LSI) circuits, the duty ratio controller may be programming software included in a random-access memory (RAM) or a read-only memory (ROM) included in the driving elements. The duty ratio controller may be driving elements separate from the signal line drive circuit 14 and the scanning line drive circuit 15, or programming software included in a RAM or a ROM in the driving elements. The duty ratio controller may be a control circuit mounted on an external circuit board.

(7) The display device may include a duty ratio controller to control a low-tone duty ratio for one frame period of the low-tone emission period W11 and a high-tone duty ratio for one frame period of the high-tone emission period W12. In response to a luminance adjustment signal for the multiple pixel units 12, the duty ratio controller may change a ratio between the low-tone duty ratio and the high-tone duty ratio and change the low-tone duty ratio and the high-tone duty ratio. The duty ratio controller changes the ratio between the low-tone duty ratio and the high-tone duty ratio, but can also change the low-tone duty ratio and the high-tone duty ratio. The duty ration controller can thus control the low-tone duty ratio and the high-tone duty ratio with high accuracy.

(8) The display device may include a substrate having a pixel unit mount surface receiving the multiple pixel units 12, an opposite surface opposite to the pixel unit mount surface, and a side surface, and a drive on the opposite surface to drive the low-tone driver A1 and the high-tone driver A2. This eliminates the mounting of the drive on a frame in the pixel unit mount surface of the substrate, thus enabling high-quality image display on a large area. A composite display device including multiple display devices with their side surfaces connected (tiled) together has less visible connections between the display devices to maintain the continuity of an image on the connections.

(9) The substrate may include side wiring on the side surface. The side wiring may connect the low-tone driver A1 and the high-tone driver A2 with drives A1 and A2. This eliminates feedthrough conductors, such as through-holes, to be included in the substrate for connecting the low-tone driver A1 and the high-tone driver A2 with the drives A1 and A2. The pixel unit mount surface uses no space for feedthrough conductors, reducing the area of the display device and downsizing the display device.

INDUSTRIAL APPLICABILITY

The display device according to one or more embodiments of the present invention can be used in various electronic devices. Such electronic devices include composite and large display devices (multi-displays), automobile route guidance systems (car navigation systems), ship route guidance systems, aircraft route guidance systems, smartphones, mobile phones, tablets, personal digital assistants (PDAs), video cameras, digital still cameras, electronic organizers, electronic books, electronic dictionaries, personal computers, copiers, terminals for game devices, television sets, product display tags, price display tags, programmable display devices for industrial use, car audio systems, digital audio players, facsimile machines, printers, automatic teller machines (ATMs), vending machines, digital display watches, smartwatches, and information display devices installed in, for example, stations and airports.

The present invention may be embodied in various forms without departing from the spirit or the main features of the present invention. The embodiments described above are thus merely illustrative in all respects. The scope of the present invention is defined not by the description given above but by the claims. Any modifications and alterations contained in the claims fall within the scope of the present invention.

REFERENCE SIGNS LIST

10, 10*a* display device
11 light emitter
12 pixel unit
13 display screen
14 signal line drive circuit
15 scanning line drive circuit
A, A1 pixel circuit
A1, A11 low-tone driver
A2, A12 high-tone driver
Sig data signal line
GL(L) low-tone scanning line
GL(H) high-tone scanning line
EMI(L) low-tone emission control line
EMI(H) high-tone emission control line
VDD first power supply line
VSS second power supply line
Tg(L) low-tone scanning transistor
Tg(H) high-tone scanning transistor
C(L) low-tone capacitor
C(H) high-tone capacitor
Td(L) low-tone drive transistor
Td(H) high-tone drive transistor
Ts(L) low-tone emission control transistor
Ts(H) high-tone emission control transistor
W11 low-tone emission period
W12 high-tone emission period

The invention claimed is:

1. A display device, comprising:

a plurality of pixel units arranged in a matrix of rows and columns, each of the plurality of pixel units including a light emitter and a pixel circuit, the light emitter being configured to emit light with a luminance level changeable in response to a level of a current, the pixel circuit being configured to cause the light emitter to emit light with a luminance level corresponding to a tone resulting from an image signal, wherein the pixel circuit includes a low-tone driver configured to drive the light emitter in response to a tone resulting from an image signal being within a low-tone range of tones below or equal to a predetermined tone, and not to drive the light emitter in response to a tone resulting from an image signal being within a high-tone range of tones above the predetermined tone, and a high-tone driver configured not to drive the light emitter in response to a tone resulting from an image signal being within the low-tone range, and to drive the light emitter in response to a tone resulting from an image signal being within the high-tone range;

a data signal line for each column of the matrix of the plurality of pixel units;

a first power supply line configured to receive a power supply voltage;

a second power supply line configured to receive a power supply voltage lower than the power supply voltage for the first power supply line;

a low-tone scanning line for each row of the matrix;

a low-tone emission control line for each row of the matrix;

a high-tone scanning line for each row of the matrix;

a high-tone emission control line for each row of the matrix;

a signal line drive circuit configured to output an image signal to the data signal line; and a scanning line drive circuit configured to output a selection signal to the low-tone scanning line and to the high-tone scanning line, wherein the low-tone driver includes a low-tone scanning transistor including a gate terminal connected to the low-tone scanning line and a source terminal connected to the data signal line, a low-tone capacitor including a first terminal connected to a drain terminal of the low-tone scanning transistor and a second terminal connected to the first power supply line, a low-tone drive transistor including a gate terminal connected to the first terminal of the low-tone capacitor and a source terminal connected to the first power supply line, and a low-tone emission control transistor including a gate terminal connected to the low-tone emission control line, a drain terminal connected to an anode of the light emitter, and a source terminal connected to a drain terminal of the low-tone drive transistor, the high-tone driver includes a high-tone scanning transistor including a gate terminal connected to the high-tone scanning line and a source terminal connected to the data signal line, a high-tone capacitor including a first terminal connected to a drain terminal of the high-tone scanning transistor and a second terminal connected to the first power supply line, a high-tone drive transistor including a gate terminal connected to the first terminal of the high-tone capacitor and a source terminal connected to the first power supply line, and a high-tone emission control transistor including a gate terminal connected to the high-tone emission control line, a drain terminal connected to the anode of the light emitter, and a source terminal connected to a drain terminal of the high-tone drive transistor, and the light emitter is connected between the drain terminal of the low-tone emission control transistor and the second power supply line and between the drain terminal of the high-tone emission control transistor and the second power supply line.

2. The display device according to claim 1, wherein the low-tone driver and the high-tone driver are selectively driven independently of each other.

3. The display device according to claim 1, wherein the second power supply line has a ground potential.

4. The display device according to claim 1, wherein a duty ratio for one frame period of a low-tone emission period during a low-tone light emission operation of the low-tone driver is smaller than a duty ratio for one frame period of a high-tone emission period during a high-tone light emission operation of the high-tone driver.

5. The display device according to claim 3, wherein the duty ratio for one frame period of the low-tone emission period is 0.1 to 10%.

6. The display device according to claim 1, wherein the low-tone driver drives the light emitter with a current having a maximum level greater than or equal to a maximum level of a current with which the high-tone driver drives the light emitter.

7. The display device according to claim 1, wherein the light emitter emits light with a chromaticity level changeable in response to a level of a current.

8. The display device according to claim 7, wherein the light emitter includes a light-emitting diode.

9. The display device according to claim 1, wherein the predetermined tone is within a range of ⅛ to ¼ of a highest tone.

10. The display device according to claim 9, wherein the highest tone is 256, and the predetermined tone is within a range of 32 to 64.

11. The display device according to claim 1, further comprising:

a duty ratio controller configured to control a low-tone duty ratio for one frame period of a low-tone emission period and a high-tone duty ratio for one frame period of a high-tone emission period, wherein in response to a luminance adjustment signal for the plurality of pixel units, the duty ratio controller maintains a constant ratio between the low-tone duty ratio and the high-tone duty ratio, and changes the low-tone duty ratio and the high-tone duty ratio.

12. The display device according to claim 1, further comprising:

a duty ratio controller configured to control a low-tone duty ratio for one frame period of a low-tone emission period and a high-tone duty ratio for one frame period of a high-tone emission period, wherein in response to a luminance adjustment signal for the plurality of pixel units, the duty ratio controller changes a ratio between the low-tone duty ratio and the high-tone duty ratio, and changes the low-tone duty ratio and the high-tone duty ratio.

13. A display device, comprising:

a plurality of pixel units arranged in a matrix of rows and columns, each of the plurality of pixel units including a light emitter and a pixel circuit, the light emitter being configured to emit light with a luminance level changeable in response to a level of a current, the pixel circuit being configured to cause the light emitter to emit light with a luminance level corresponding to a tone resulting from an image signal, wherein the pixel circuit includes a low-tone driver configured to drive the light emitter in response to a tone resulting from an image signal being within a low-tone range of tones below or equal to a predetermined tone, and not to drive the light emitter in response to a tone resulting from an image signal being within a high-tone range of tones above the predetermined tone, and a high-tone driver configured not to drive the light emitter in response to a tone resulting from an image signal being within the low-tone range, and to drive the light emitter in response to a tone resulting from an image signal being within the high-tone range;

a low-tone signal line for each column of the matrix of the plurality of pixel units;

a first power supply line configured to receive a power supply voltage;

a second power supply line configured to receive a power supply voltage lower than the power supply voltage for the first power supply line;

a high-tone signal line for each column of the matrix of the plurality of pixel units;

a scanning line for each row of the matrix;

a low-tone emission control line for each row of the matrix;

a high-tone emission control line for each row of the matrix;

a signal line drive circuit configured to output an image signal to the low-tone signal line and the high-tone signal line; and a scanning line drive circuit configured to output a selection signal to the scanning line, wherein the low-tone driver includes a low-tone scanning transistor including a gate terminal connected to the scanning line and a source terminal connected to the low-tone signal line, a low-tone capacitor including a first terminal connected to a drain terminal of the low-tone scanning transistor and a second terminal connected to the first power supply line, a low-tone drive transistor including a gate terminal connected to the first terminal of the low-tone capacitor and a source terminal connected to the first power supply line, and a low-tone emission control transistor including a gate terminal connected to the low-tone emission control line, a drain terminal connected to an anode of the light emitter, and a source terminal connected to a drain terminal of the low-tone drive transistor, the high-tone driver includes a high-tone scanning transistor including a gate terminal connected to the scanning line and a source terminal connected to the high-tone signal line, a high-tone capacitor including a first terminal connected to a drain terminal of the high-tone scanning transistor and a second terminal connected to the first power supply line, a high-tone drive transistor including a gate terminal connected to the first terminal of the high-tone capacitor and a source terminal connected to the first power supply line, and a high-tone emission control transistor including a gate terminal connected to the high-tone emission control line, a drain terminal connected to the anode of the light emitter, and a source terminal connected to a drain terminal of the high-tone drive transistor, and the light emitter is connected between the drain terminal of the low-tone emission control transistor and the second power supply line and between the drain terminal of the high-tone emission control transistor and the second power supply line.

14. The display device according to claim 13, wherein the low-tone driver and the high-tone driver are selectively driven at a same time.

15. The display device according to claim 13, wherein the second power supply line has a ground potential.

* * * * *